United States Patent [19]

Williams

[11] Patent Number: 4,461,428

[45] Date of Patent: Jul. 24, 1984

[54] APPARATUS FOR REDUCING FRAIBLE MATERIALS INTO COARSE AND FINE FRACTIONS

[75] Inventor: Robert M. Williams, Ladue, Mo.

[73] Assignee: Williams Patent Crusher and Pulverizer Company, St. Louis, Mo.

[21] Appl. No.: 350,070

[22] Filed: Feb. 18, 1982

[51] Int. Cl.[3] ..... B02C 13/288; B02C 13/08

[52] U.S. Cl. ..... 241/34; 241/57; 241/58; 241/73; 241/79; 241/81

[58] Field of Search ..... 241/34, 48, 57, 58, 241/60, 65, 73, 79, 81, 189 R, 189 A

[56] References Cited

U.S. PATENT DOCUMENTS 3,794,251 2/1974 Williams ..... 241/81 X 4,082,228 4/1978 Paterson et al. ..... 241/34

4,245,570 1/1981 Williams ..... 241/48 X

*Primary Examiner*—Howard N. Goldberg

*Assistant Examiner*—Timothy V. Eley

*Attorney, Agent, or Firm*—Gravely, Lieder & Woodruff

[57] ABSTRACT

Apparatus for producing coarse and fine products from a common source of material and for avoiding the presence of substantial quantities of fines in the coarse product by introducing the common material ahead of the mill and establishing a flow of air or gas counter to the travel of the material through the mill so the fines are swept out of the coarse material and become the second product, or can be used as a source of fuel for producing the heat for drying the material as it is being processed in the mill apparatus.

1 Claim, 2 Drawing Figures

APPARATUS FOR REDUCING FRAIBLE MATERIALS INTO COARSE AND FINE FRACTIONS

BACKGROUND OF THE INVENTION

1. Field of the Invention

This invention pertains to apparatus for reducing friable materials into coarse and fine fractions, and more particularly to improvements in the arrangements and operation of such apparatus.

2. Description of the Prior Art

There are a number of friable materials which are rendered useful for commercial and/or industrial purposes after being reduced from the raw state in which the size or chunks vary in a non-uniform manner. Some such materials need to be dried or have the moisture considerably reduced, and that requires a heat source.

An early form of apparatus for drying or dehydrating material disclosed the intentional recombining of coarse and fine materials discharged from a hammer mill, and reference is made to Arnold et al U.S. Pat. No. 2,770,543 of Nov. 13, 1956. In the apparatus of Weston et al U.S. Pat. No. 2,916,215 of Dec. 8, 1959, all the material produced in a grinding mill is moved in a common stream to a classifier where the oversize coarse fraction is removed from the main product of a finer size.

It is known that extreme fines removed from friable material can be used as a source of fuel for generating drying heat for the rest of the material of desired size. Such apparatus is disclosed in Williams U.S. Pat. No. 3,794,251 of Feb. 26, 1974, as well as in Williams U.S. Pat. No. 3,826,208 of July 30, 1974. The separation of coarse and fine fractions produced in a reducing mill for friable materials is shown by Williams U.S. Pat. No. 4,061,274 of Dec. 6, 1977, however, the system requires all of the reduced material to be transported to a series of secondary components of equipment to effect the separation.

The problem with the apparatus of the known prior art is that the stripping of the fines from the coarse fraction must be effected outside the primary material reducing mill which calls for an excessive number of components. Furthermore, in many case, the reducing mill is incapable of allowing separation of the various fractions.

BRIEF DESCRIPTION OF THE INVENTION

The problems evident from the known prior art are overcome by an improved arrangement of apparatus where the stripping of the fine fraction from material to be reduced is accomplished in apparatus where a flow of a gaseous medium is applied at the mill to separate fines at both inlet and outlet sides of the mill, thereby doing away with a number of expensive secondary equipment. This improvement yields a principal product of a desired coarse size which is significantly much more free of fines than can be achieved by the known prior art apparatus.

An important object of the present invention is to provide apparatus which operates to initially remove as much of the fines from an incoming stream of material to a reducing mill as is possible so as to reduce the quantity of fines which are delivered with the incoming stream or are present in the reducing mill before or generated during the reduction phase.

Another important object of the present invention is to provide material reducing apparatus for friable materials with means for stripping the fine fractions from the coarse fractions at both inlet and outlet sides of the reducing mill.

A further object of the present invention is to provide apparatus for reducing friable material of various characteristics, stripping the fine fractions from the coarse fractions to produce in one operation two products differing in size, and where possible the material is combustible, utilizing the fine fractions as a source of fuel to produce heat for drying the material during reduction.

BRIEF DESCRIPTION OF THE DRAWING

The present invention is illustrated in the accompanying drawing wherein.

DESCRIPTION OF THE INVENTION

Figures 1, 2:
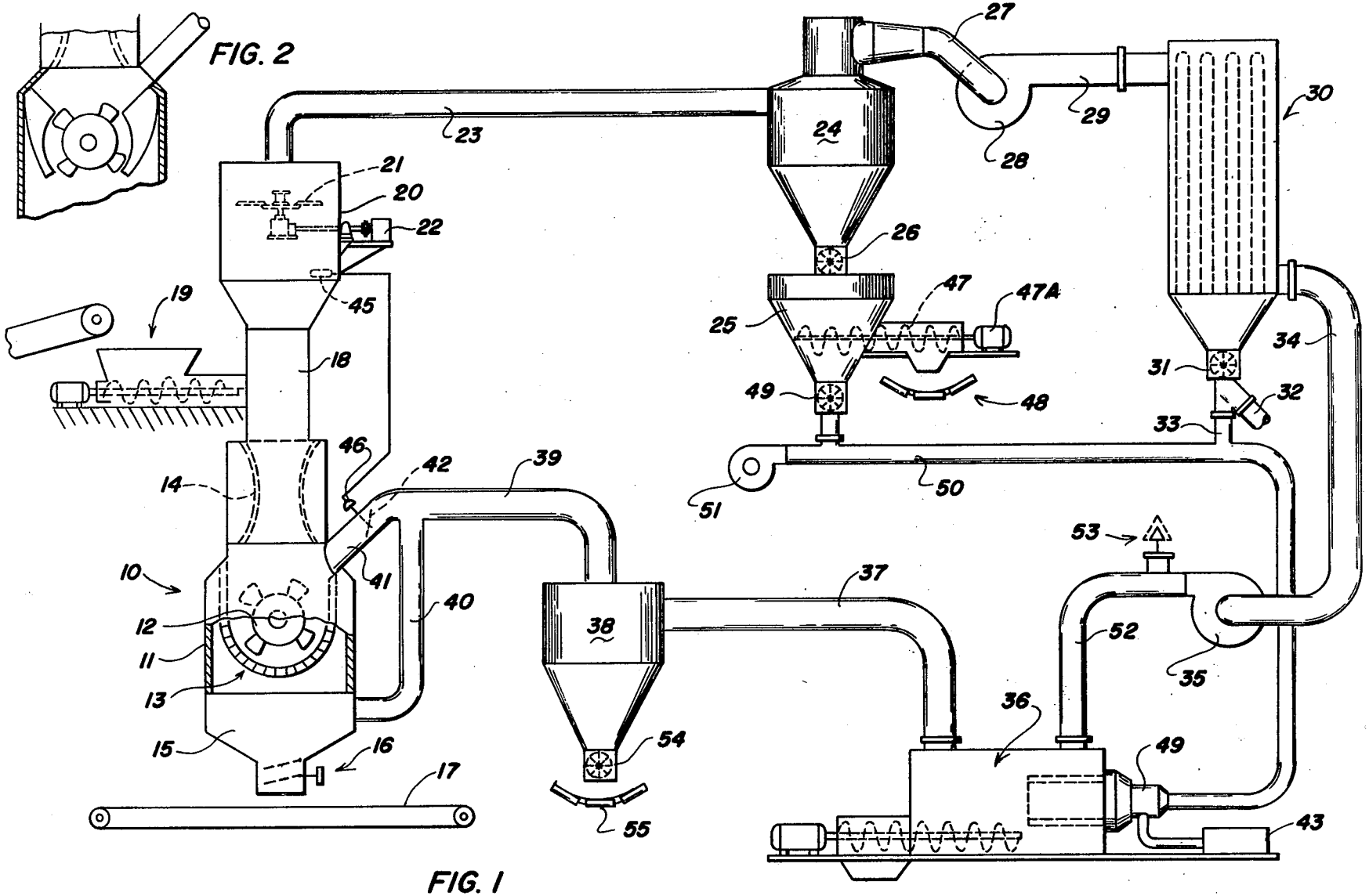
FIG. 1 is a schematic view of a complete system embodying the components and the arrangements which represents the present improvement.
FIG. 2 is a fragmentary view of a modification in the character of reducing mill of FIG. 1.

The apparatus forming the presently preferred embodiment is useful to produce a substantially uniform size of coarse material which is nearly free of fines. The material which can be treated in this apparatus includes coal; lime-stone to result in sinter flux stone for iron ore; flux stone for glass melting, or poultry grit; clay used in cement mills, brick and refractory plants; chalk and mare for cement mills; and also such material as Bauxite, kaolin and Fullers earth.

In reference to the drawing, the apparatus comprises a rotary mill 10 having a shaft 11 carrying suitable hammer discs 12 revolving in a path adjacent means 13 which is a grate wall with openings for controlling the size of the coarse material. A Venturi section 14 is disposed above the chamber in which the hammer discs 12 are exposed, and a discharge chamber 15 is below the means 13, and such chamber is provided with a suitable double flop gate 16 through which the coarse material passes to fall onto a suitable conveyor.

The apparatus is formed with an air drying column 18 extending above the Venturi throat section 14, and the material to be processed is admitted to the column 18 by feed means 19 which causes the material to fall toward the Venturi section 14. The outlet end of the column 18 opens to a centrifugal separator chamber 20 which houses revolving blades 21 driven by motor 22 for effecting the classification of heavy material from lighter weight material, the heavier material returning by gravity to the mill 10.

The apparatus includes a conduit 23 leading from the outlet of the separator chamber 20 to the inlet of a cyclone separator 24 where the fine fractions of the material are collected in a suitable bin 25 after passing a rotary gate 26. The air and dust are moved from the cyclone 24 through conduit 27 to the principal blower 28. The air from the blower 28 is conducted by conduit 29 into a bag house 30 where the dust is separated and passes a rotary valve 31 for selective discharge to outlet 32 or to conduit 33. The air from bag house 30 is moved in conduit 34 by fan 35 to a furnace 36. The heated air from the furnace 36 is carried by stack 37 to a cyclone separator 38 where a final extraction of non-combustible grit takes place. The heated air or gas is conducted by conduit 39 into the mill 10 by a principal conduit 40 connected into the chamber 15 below means 13. A branch conduit 41 is connected into the mill 10 above the rotor 12, and a control valve 42 is operably mounted in the branch 41 to regulate the proportions of heated air or gas delivered to the mill across the rotor 12 and means 13.

The operation of the furnace 36 is dependent upon its air supply from blower 35 and upon a source of fuel from means 43 supplied to the burner head 44. The heated air or gas is conducted by conduit 39 into a primary conduit 40, which is, in turn, connected into the chamber 15 of the mill 10 where it flows upwardly through the means 13. This flow strips fines from the material which has been reduced to a sized to pass the openings in means 13. The fines thus stripped, pass through the Venturi chamber 14 and strip other fines from the incoming material as it moves toward the drying column 18 on its way to the separator 20. Should the material clog or blind the means 13 so little air is able to flow through, the drop in pressure at the separator 20 will be sensed by the pressure sensitive element 45 and a signal will operate motor means 46 to open valve 42 to allow the heated air to flow through by-pass conduit 41 to the rotor chamber. This by-pass will remain operational until the means 13 works free of its clogged condition to allow restoration of the heated air flow into mill chamber 15. The material passing the flop gates 16 is moved by the conveyor 17 to a collecting station (not shown).

While a coarse product is delivered to conveyor 17, the fines stripped from the material in the manner noted, are first collected at the cyclone separator 24 and pass rotary valve 26 into a bin 25. The bin 25 is provided with a material leveling assembly comprising an auger 47 driven by motor 47A which skims the accumulating fines out of the bin 25 and into a conveyor 48. The fines from conveyor 48 are collected and become a second product. Combustible fines not skimmed out of bin 25 pass through a rotary valve 49 into conduit 50 and are blown by blower 51 into the burner 44 as a fuel supplement. Along the way, combustible fines from the bag hose conduit 33 can be added to the stream of fines moved in conduit 50. The conduit 52 from blower 35 is provided with a vent 53. The vent allows escape of moisture and gases which have passed through the system to the vent.

The burning of fines can be expected to produce fly-ash residue which is extracted at the cyclone 38 and passes rotary valve 54 to a conveyor 55 for suitable disposal.

The apparatus described above operates in a unique manner to strip fines from the incoming material due to the flow of air above the Venturi section 14. The coarse material falls through the Venturi section and is reduced in the mill 10 until it reaches a size to pass through the means 13. The action of the hammer rotor 12 produces additional fines which would normally fall through the means 13. However, the flow of heated air into the chamber 15 acts to reverse the gravitational influence and strip those fines and carry them back through the means 13 to join the fines moved through the column 18. Some coarse fractions at a time are carried into the separator 20 where they are separated by spinning blades 21 (Williams U.S. Pat. No. 4,184,640 of Jan. 22, 1980) and fall back through the column 18 into the mill 10.

The fines separated out in the above apparatus fall into a class of fractions of a size that are smaller than a 40 to 60 mesh screen. The coarse fractions are larger and have a nearly uniform size, depending on the openings in the means 13. The means 13 can be a wall with holes of about a $\frac{3}{8}''$ diameter size, or larger if desired. The initial stripping of fines above the Venturi section 14 reduces the generation of fines in the mill 10. When running wet material, the stripping action above the Venturi reduces the problem of fines blinding the openings in means 13, and that improves the heat exchange with the material to reduce the dry time requirement. The temperature of the drying gas supplied from the furnace 36 can be in the range of 1200° to 1500° F. The drying gas in stack 37 will be relatively inert as disclosed in my earlier U.S. Pat. Nos. 3,477,650 granted Nov. 11, 1969, and 4,226,371 granted Oct. 7, 1980.

The foregoing has set forth apparatus in which coarse fractions of material are released below the mill and fine fractions are stripped off the incoming material before it can enter the mill and be transported to a place of discharge or to a furnace where it can act as a fuel to produce drying heat. The result is that the apparatus is able to produce a substantially dry granular product with a minimum of extreme fines, and by minimizing the pressure or inclusion of fines in the working chamber of the mill, the mill outlet means 13 can be prevented from becoming clogged or blinded.

FIG. 2 illustrates a modification for the mill 10 to avoid using the means 13 below the rotating hammers carried by disc 12. The opposite walls in the grinding chamber adjacent the rotating disc 12 carry blocks or impact means 13A which are closely set to the path of movement of the hammers and function to reduce the size of the opening for the passage of the material. This then allows the desired size of material to pass, and since there is nothing below the hammer rotor disc 12, the material of the desired coarse size relative to the fines, falls onto conveyor 17.

In either form of mill 10, the hammer rotor disc is constructed so it can be reversed to extend the life of the hammers. In addition, the present system has the important advantage over prior systems, in that by separating the coarse material from the fines the fan 28 can be reduced in size and will require less horsepower. An important reason for this economy is that the coarse fractions are essentially separated at the rotary fragmenter and do not have to be transported by a fan. The system produces two different sizes of product which can be handled in distinct ways, or they may be recombined outside the system so less energy is needed.

Should the material be exceptionally wet or have a high moisture content such that the means 13 might be blided, the differential pressure sensitive element 45 can react to open the damper 42 and allow the heated air flow to by-pass the mill until the conditions are restored to the place where the heated air flow returns to the chamber 15. The stripping of the fines above the mill will continue during the time the means 13 is clogged or blinded.

What is claimed is:

1. Apparatus for reducing material and distinguishing between coarse fractions and fine fractions, said apparatus comprising:

(a) a material reducing mill having a rotary material fragmenter and adjacent wall means defining passage for the coarse fractions produced by said rotary fragmenter;

(b) means for feeding material to be reduced;

(c) passage forming means connecting said feeding means with said reducing mill, and including a Venturi section between said feeding means and said reducing mill;

(d) conduit means connected across said reducing mill and passage forming means said conduit means including a first branch connected into said material reducing mill below said rotary material fragmenter, a second branch conduit connected into said material reducing mill above said rotary material fragmenter;

(e) fluid flow propelling means connected into said conduit means and operable to create a flow of gaseous fluid through said reducing mill and passage forming means, said gaseous fluid flow acting to strip fine fractions from coarse fractions passing through said wall means and further stripping fine fractions from material introduced by said feeding means into said passage forming means;

(f) means for discharging the coarse fractions from said reducing mill, and for discharging the fine fractions at a predetermined location in said conduit means;

(g) a source of heated gaseous medium connected to said conduit means;

(h) flow control valve means operably mounted in said second branch conduit; and (i) operating means connected to said valve means, said operating means being responsive to the fluid flow pressure in said passage forming means for positioning said valve means to allow heated gaseous medium to flow in said second branch conduit for maintaining a predetermined fluid flow pressure in said passage forming means.

* * * * *